US005329306A

United States Patent [19]

Carlotta

[11] Patent Number: 5,329,306

[45] Date of Patent: Jul. 12, 1994

[54] WASTE INK SEPARATOR FOR INK JET PRINTER MAINTENANCE SYSTEM

[75] Inventor: Michael Carlotta, Sodus, N.Y.

[73] Assignee: Xerox Corporation, Stamford, Conn.

[21] Appl. No.: 974,764

[22] Filed: Nov. 12, 1992

[51] Int. Cl.[5] ..... B41J 2/175

[52] U.S. Cl. ..... 349/90

[58] Field of Search ..... 346/140 R

[56] References Cited

U.S. PATENT DOCUMENTS

| | | | |
|---|---|---|---|
| Re. 32,572 | 1/1988 | Hawkins et al. | 156/626 |
| 4,364,065 | 12/1982 | Yamamori et al. | 346/140 R |
| 4,571,599 | 2/1986 | Rezanka | 346/140 R |
| 4,638,337 | 1/1987 | Torpey et al. | 346/140 R |
| 4,679,059 | 7/1987 | Dagna | 346/140 R |
| 4,746,938 | 5/1988 | Yamamori et al. | 346/140 R |
| 4,849,774 | 7/1989 | Endo et al. | 346/140 R |
| 4,853,717 | 8/1989 | Harmon et al. | 346/140 R |
| 4,855,764 | 8/1989 | Humbs et al. | 346/140 R |
| 5,121,130 | 6/1992 | Hempel et al. | 346/1.1 |

FOREIGN PATENT DOCUMENTS

| | | | |
|---|---|---|---|
| 61-12352 | 1/1986 | Japan | 346/140 R |

*Primary Examiner*—Benjamin R. Fuller
*Assistant Examiner*—Valerie Ann Lund
*Attorney, Agent, or Firm*—Robert A. Chittum

[57] ABSTRACT

A waste ink separator is used in an ink jet printer maintenance station for management of the waste ink generated during printhead priming operations. The separator primarily consists of three main components, viz., a rigid chamber body with side walls and a top wall with an inlet and outlet therein, a chamber floor constructed of a material having a high moisture vapor transfer rate to pass moisture therethrough, and a foam material housed in the interior of the chamber body and floor for absorbing and storing waste liquid ink. The internal surface of the chamber top wall has interleaved parallel ribs which provide a serpentine floor path between the chamber inlet and outlet about the foam material for separating the liquid ink from the air.

6 Claims, 2 Drawing Sheets

WASTE INK SEPARATOR FOR INK JET PRINTER MAINTENANCE SYSTEM

BACKGROUND OF THE INVENTION

The present invention relates to ink jet printing apparatus and is concerned, more particularly, with management of waste ink generated in a printing apparatus maintenance system for a printhead and ink supply cartridge in such apparatus.

An ink jet printer of the so-called "drop-on-demand" type has at least one printhead from which droplets of ink are directed towards a recording medium. Within the printhead, the ink may be contained in a plurality of channels and energy pulses are used to cause the droplets of ink to be expelled, as required, from orifices at the ends of the channels.

In a thermal ink jet printer, the energy pulses are usually produced by resistors, each located in a respective one of the channels, which are individually addressable by current pulses to heat and vaporize ink in the channels. As a vapor bubble grows in any one of the channels, ink bulges from the channel orifice until the current pulse has ceased and the bubble begins to collapse. At that stage, the ink within the channel retracts and separates from the bulging ink which forms a droplet moving in a direction away from the channel and towards the recording medium. The channel is then re-filled by capillary action, which in turn draws ink from a supply container. Operation of a thermal ink jet printer is described in, for example, U.S. Pat. No. 4,849,774.

One particular form of thermal ink jet printer is described in U.S. Pat. No. 4,638,337. That printer is of the carriage type and has a plurality of printheads, each with its own ink supply cartridge, mounted on a reciprocating carriage. The channel orifices in each printhead are aligned perpendicular to the line of movement of the carriage and a swath of information is printed on the stationary recording medium as the carriage is moved in one direction. The recording medium is then stepped, perpendicular to the line of carriage movement, by a distance equal to the width of the printed swath and the carriage is then moved in the reverse direction to print another swath of information.

It has been recognized that there is a need to maintain the ink ejecting orifices of an ink jet printer, for example, by periodically cleaning the orifices when the printer is in use, and/or by capping the printhead when the printer is out of use or is idle for extended periods. The capping of the printhead is intended to prevent the ink in the printhead from drying out. There is also a need to prime a printhead before initial use, to ensure that the printhead channels are completely filled with ink and contain no contaminants or air bubbles. After much printing and at the discretion of the user, an additional but reduced volume prime may be needed to clear particles or air bubbles which cause visual print defects. Maintenance and/or priming stations for the printheads of various types of ink jet printers are described in, for example, U.S. Pat. Nos. 4,364,065; 4,855,764; 4,853,717 and 4,746,938 while the removal of gas from the ink reservoir of a printhead during printing is described in U.S. Pat. No. 4,679,059.

It has been found that the priming operation, which usually involves either forcing or drawing ink through the printhead, can leave drops of ink on the face of the printhead and that, ultimately, there is a build-up of ink residue on the printhead face. That residue can have a deleterious effect on print quality. It has also been found that paper fibers and other foreign material can collect on the printhead face while printing is in progress and, like the ink residue, can also have a deleterious effect on print quality. It has previously been proposed, in U.S. Pat. No. 4,853,717, that a printhead should be moved across a wiper blade at the end of a printing operation so that paper dust and other contaminants are scraped off the orifice plate before the printhead is capped. It has also been proposed, in U.S. Pat. No. 4,746,938, that an ink jet printer should be provided with a washing unit which, at the end of a printing operation, directs water at the face of the printhead to clean the latter before it is capped. U.S. Pat. No. 5,121,130 discloses directing waste ink generated by a priming operation to the main ink supply tank for reuse.

SUMMARY OF THE INVENTION

It is an object of the present invention to provide a cost effective means for managing waste ink generated during priming of the print cartridge of an ink jet printer by separating the ink from air in a separator, storing the ink therein, and evaporating the liquid portion of the ink therefrom.

In the present invention, a maintenance station is provided for an ink jet printer having a printhead with nozzles in a nozzle face and an ink supply cartridge mounted on a translatable carriage for concurrent movement therewith. When the printer is in a non-printing mode, the carriage is translated to the maintenance station located outside and to one side of a printing zone, where various maintenance functions are provided depending upon the location of the carriage mounted printhead within the maintenance station. At a capping location, a carriage actuatable cap moves into sealing engagement with the printhead nozzle face and surrounds the nozzles to provide a controllable environment therefor. A vacuum pump is interconnected to the cap by flexible hose with a waste ink separator therebetween. The separator primarily consists of three components; namely, a rigid chamber body with sidewalls and a top wall having an inlet and outlet therein, a chamber floor constructed of a material having a high moisture vapor rate for release of moisture therethrough, and a foam material housed in the interior of the combined chamber body and floor. The foam absorbs and stores the waste liquid ink. The internal surface of the chamber top wall has interleaved ribs which press against the foam material and provide a serpentine flow path between the chamber body inlet and outlet above the foam material so that liquid ink is separated from the air. Priming is conducted when continued movement of the carriage mounted printhead to a predetermined location actuates a pinch valve to isolate the separator from the cap for a predetermined time and enable a predetermined vacuum to be produced therein by energizing the vacuum pump. Once the carriage mounted printhead returns to the capping location, the pinch valve is opened subjecting the printhead to the separator vacuum and ink is drawn from the printhead nozzle to the separator. Movement of the carriage mounted printhead to a location in the maintenance station where the nozzle face is uncapped stops the prime and enables ink to be removed from the cap to the separator. The vacuum pump is de-energized and the printhead is returned to the capping location to await the printing mode of the printer.

BRIEF DESCRIPTION OF THE DRAWINGS

By way of example, an embodiment of the invention will be described with reference to the accompanying drawings, wherein like numerals indicate like parts and in which.

DESCRIPTION OF THE PREFERRED EMBODIMENT

Figure 1:
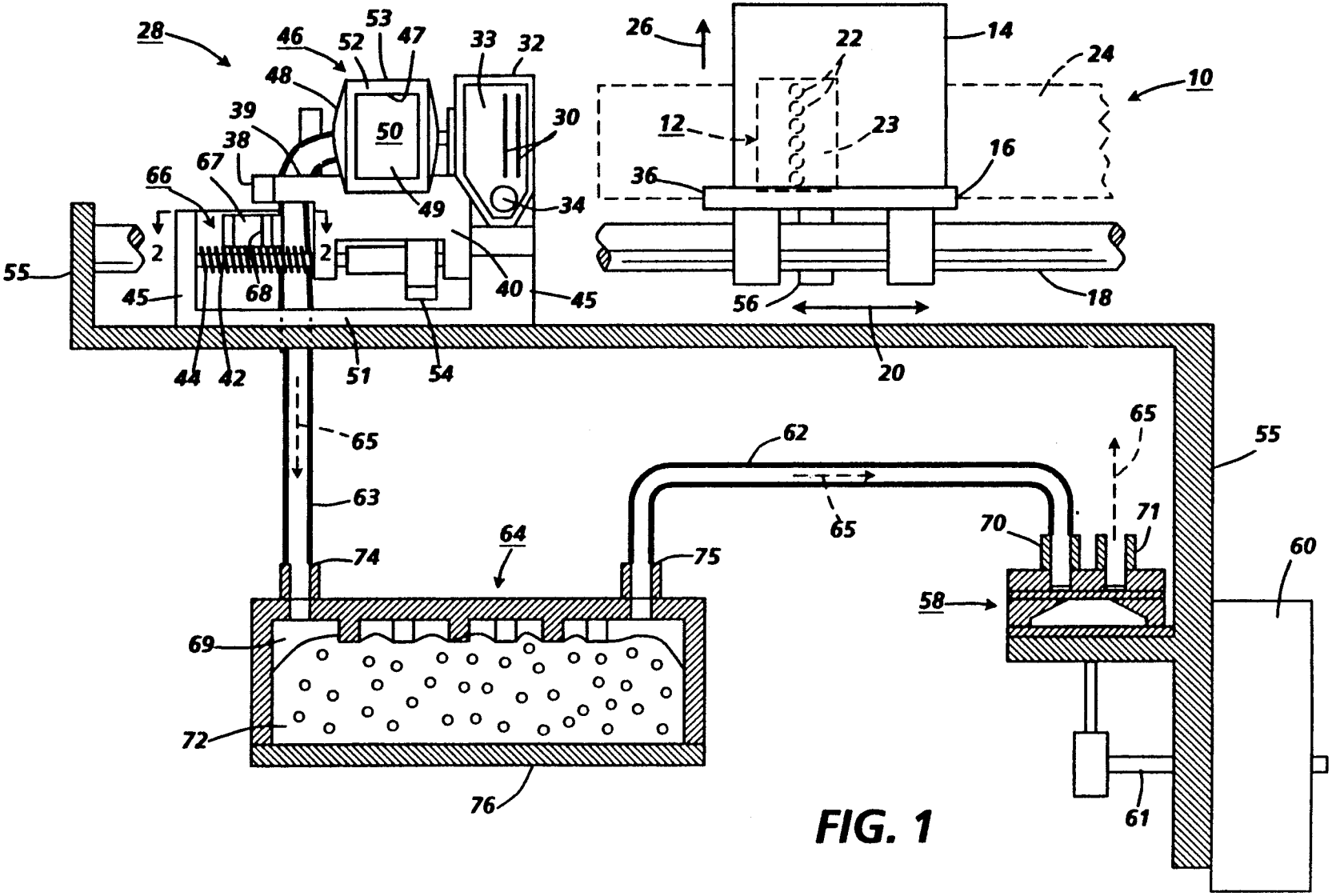
FIG. 1 is a schematic front elevation view of a partially shown ink jet printer having the maintenance station with the waste ink separator of the present invention.

The printer 10 shown in FIG. 1 has a printhead 12, shown in dashed line, which is fixed to ink supply cartridge 14. The cartridge is removably mounted on carriage 16, and is translatable back and forth on guide rails 18 as indicated by arrow 20, so that the printhead and cartridge move concurrently with the carriage. The printhead contains a plurality of ink channels (not shown) which terminate in nozzles 22 in nozzle face 23 (both shown in dashed line) and carry ink from the cartridge to respective ink ejecting nozzles 22. When the printer is in the printing mode, the carriage translates or reciprocates back and forth across and parallel to a printing zone 24 (shown in dashed line) and ink droplets (not shown) are selectively ejected on demand from the printhead nozzles onto a recording medium (not shown), such as paper, in the printing zone, to print information thereon one swath at a time. During each pass or translation in one direction of the carriage 16, the recording medium is stationary, but at the end of each pass, the recording medium is stepped in the direction of arrow 26 for the distance of the height of one printed swath. For a more detailed explanation of the printhead and printing thereby, refer to U.S. Pat. Nos. 4,571,599 and Re. 32,572, incorporated herein by reference.

At one side of the printer, outside the printing zone, is a maintenance station 28. At the end of a printing operation or termination of the printing mode by the printer 10, the carriage 16 is first moved past at least one fixed wiper blade 30 and preferably a pair of fixed, but separate, parallel, spaced wiper blades, so that the printhead nozzle face 23 is wiped free of ink and debris every time the printhead and cartridge (hereinafter print cartridge) enters or exits the maintenance station. Adjacent the wiper blade in the direction away from the printing zone and at a predetermined location along the translating path of the print cartridge is a fixedly mounted collection container 32. The carriage will position the print cartridge at this collection container, sometimes referred to as a spit station or spittoon, after the print cartridge has been away from the maintenance station for a specific length of time, even if continually printing, because not all nozzles will have ejected enough ink droplets to prevent the ink or meniscus in the little used nozzles from drying and becoming too viscous. Accordingly, the print cartridge will be moved by, for example, a carriage motor (not shown) under the control of the printer controller (not shown) past the printer blades, cleaning the nozzle face, and to the predetermined location confronting the collection container, whereat the printer controller causes the printhead to eject a number of ink droplets therein. In the preferred embodiment, the printhead will eject about 100 ink droplets into the collection container. Preferably, the wiper blade or blades are also located within the collection container so that ink may run or drip off the blades and be collected in the collection container. The collection container has a surface 33 which is substantially parallel to the printhead nozzle face and oriented in a direction so that the force of gravity causes the ink to collect in the bottom thereof where an opening 34 is located for the ink to drain therethrough into a pad of absorbent material (not shown) behind the collection container. The pad of absorbent material absorbs the ink and is partially exposed to the atmosphere, so that the liquid portion of the ink absorbed therein evaporates maintaining adequate ink storage volume for repeated subsequent cycles of priming and nozzle clearing droplet ejections.

When the carriage 16 continues along guide rails 18 beyond the collection container for a predetermined distance, the carriage actuator edge 36 contacts the catch 38 on arm 39 of the cap carriage 40. Cap carriage 40 has a cap 46 and is reciprocally mounted on guide rail 42 for translation in a direction parallel with the carriage 16 and print cartridge mounted thereon. The cap carriage is biased towards the collection container by spring 44 which surrounds guide rail 42. The cap 46 has a closed wall 47 extending from a bottom portion 48 of the cap to provide an internal recess 49 having a piece of absorbent material 50 therein. The top edge 52 of the wall 47 and preferably the outside surfaces of wall 47 including the top edge is covered by a resilient rubber like material 53, such as, Krayton ®, a product of Shell Chemical Company, having a shore A durometer 45 to form a seal. In the preferred embodiment, resilient material 53 is molded onto the outside walls of wall 47. The cap is adapted for movement from a location spaced from the plane containing the printhead nozzle face to a location wherein the cap seal intercepts the plane containing the printhead nozzle in response to movement by the cap carriage. After the carriage actuator edge 36 contacts the catch 38, the print cartridge carriage and cap carriage move in unison to a location where the cap is sealed against the printhead nozzle face. At this location, the cap closed wall surrounds the printhead nozzles and the cap seal tightly seals the cap recess around the nozzles. During this positioning the cap against the printhead nozzle face, the cap carriage is automatically locked to the print cartridge by pawl 54 in cooperation with pawl lock edge 56 on the carriage 16. This lock by the pawl together with the actuator edge 36 in contact with catch 38 prevents excessive relative movement between the cap 46 and the printhead nozzle face 23.

Once the printhead nozzle face is capped and the cap is locked to the print cartridge, the printer controller may optionally cause the printhead to eject a predetermined number of ink droplets into the cap recess 49 and absorbent material 50 therein for the purpose of increasing humidity in the sealed space of the cap recess.

A typical diaphragm vacuum pump 58 is mounted on the printer frame 55 and is operated by any known drive means, but in the preferred embodiment, the vacuum pump is operated by the printer paper feed motor 60 through motor shaft 61, since this motor does not need to feed paper during printhead maintenance, and this dual use eliminates the need for a separate dedicated motor for the vacuum pump. The vacuum pump is connected to the cap 46 by flexible hoses 62, 63 and an ink separator 64, described below, is located intermediate the cap and vacuum pump.

Figure 2:
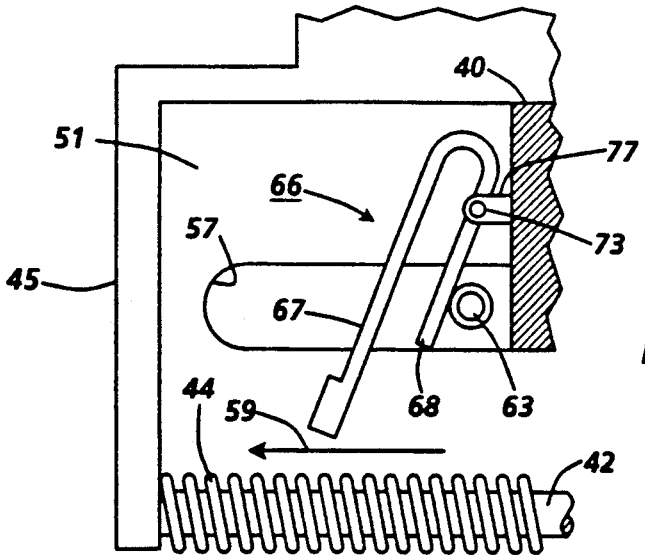
FIG. 2 is a partial cross-sectional view of the maintenance station as viewed along section line 2—2 in FIG. 1 showing the carriage actuated pinch valve.

The cap carriage guide rail 42 is fixedly positioned between fixed upstanding support members 43, 45 which extend from base 51 removably attached to the printer frame 55. Referring to FIG. 2, base 51 has an elongated slot 57 for passage of the flexible hose 63 and to accommodate movement of the flexible hose therein. A pinch valve 66 having a U-shaped structure is rotatably attached to the cap carriage 40 by a fixed cylindrical shaft 73 on leg 68 of the U-shaped structure, which is pivoted in flanges 77, so that movement of the cap carriage toward upstanding support member 45, as indicated by arrow 59, will eventually bring the other leg 67 of the U-shaped structure into contact with fixed support member 45, pinching the flexible tube 63 closed. The pinch valve is preferably of a uniform construction and of a plastic material. It is designed such that tolerances in print carriage positioning can be accommodated by deflections of pinch valve leg 67 which acts as a spring-beam. This beam deflection by leg 67 is designed to be within the stress limits of the material and, in the preferred embodiment, can tolerate ±0.8 mm mispositioning of the carriage from nominal pinch position.

Thus, at one predetermined location along guide rails 18 the print cartridge, through engagement of the carriage actuator edge 36 and catch 38 of the cap carriage, will cause the printhead nozzle face to be capped but the tube 63 will not be pinched shut. This will be referred to as the capped position, and the nozzle face is subjected to humidified, ambient pressure air through the cartridge vent (not shown) and vacuum pump valves 70, 71 through separator 64.

Figure 3:
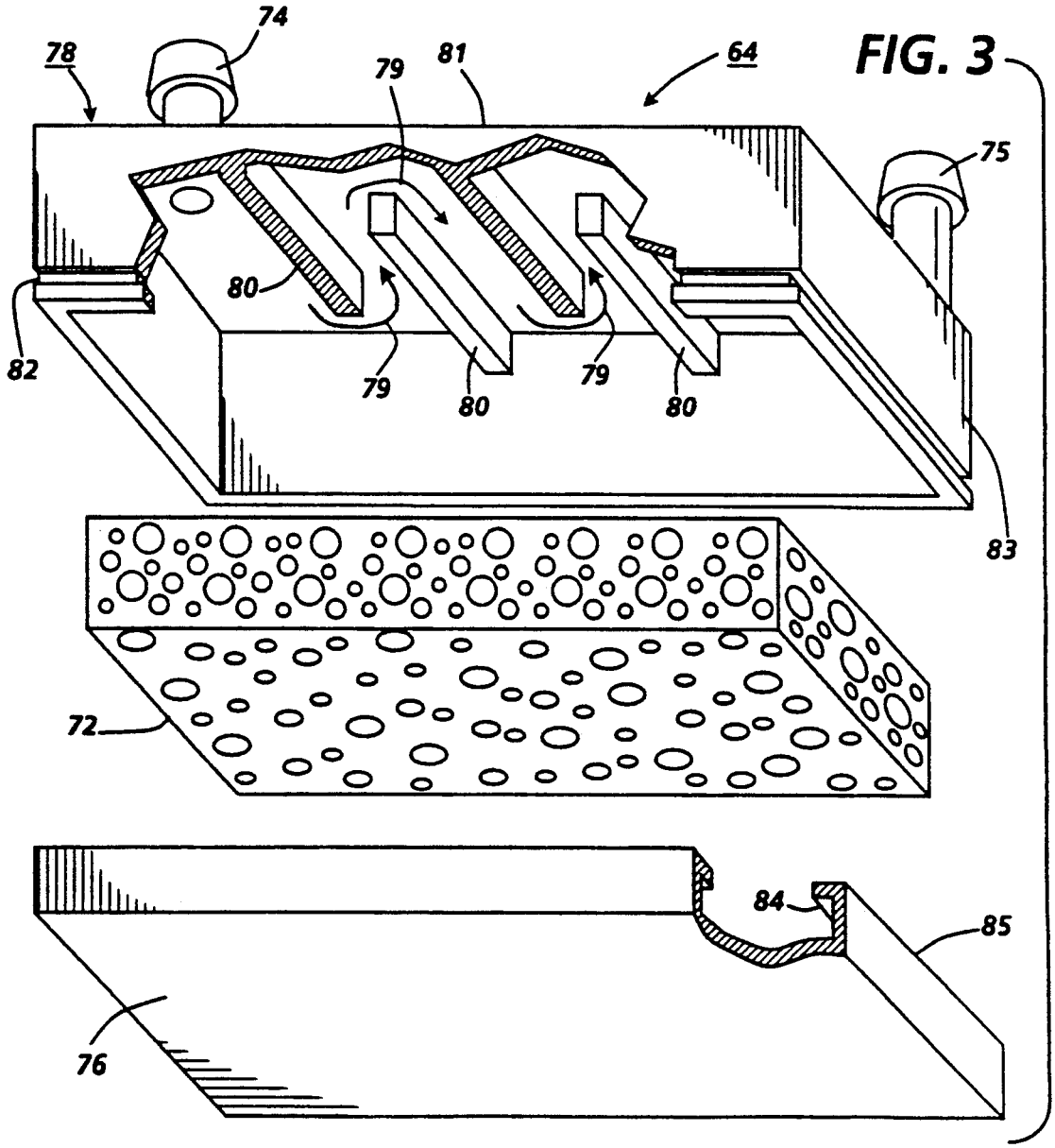
FIG. 3 is an isometric exploded view of the waste ink separator with portions removed for clarity.

Referring to FIG. 3, an isometric exploded view of the separator 64, the separator is shown as having three primary parts; namely a chamber body 78 having four side walls 83 and a top wall 81 with inlet 74 and outlet 75 therein, a foam material 72, and a chamber floor 76. The interior surface of the top wall has a plurality of parallel ribs 80. The ribs alternately extend from opposing side walls, but do not extend the entire length between the opposing sidewalls, so as to form a serpentine flow path as indicated by arrows 79. The floor 76 of the separator has relatively short side walls 85 extending upwardly therefrom with an inwardly directed rim 84 all around the upper edge of the sidewalls. Foam material 72 substantially fills the interior of the separator, but ribs 80 pressing against the foam material provide empty space 69 (see FIG. 1) in the form of a serpentine pathway between the separator inlet and outlet. The separator chamber body material is selected for ink compatibility, structural rigidity, low cost, and very low moisture vapor transfer rate. Many different materials meet these requirements, but the material used by the preferred embodiment is polyethylene. The outer surface of the chamber body sidewalls 83 have a groove 82 around the entire outer periphery of the sidewalls near the edges opposite the one connected to the top wall. The groove 82 is coplanar and substantially parallel to the chamber body top wall and is adapted to receive the inwardly directed rim 84 of the chamber floor 76. The chamber floor material is selected both for flexibility to enable a tight snap assembly of the rim 84 into the groove 82 and for a high moisture vapor transfer rate, a very important feature of the separator as explained later. The tight snap assembly of the floor onto the chamber sidewalls provides a seal between the two parts.

The internal air volume of the separator is limited primarily to the space above the foam material and initial voids in the foam cells, and the overall air volume is limited to that imposed upon it by the vacuum pump 58 design and maintenance station pressure parameters and printer size limitations. In the preferred embodiment, the open space capacity is abut 30 cc, when empty, and can handle around 112 continuous priming operations at 0.25 cc of ink per prime. An average user may replace a print cartridge once a month, which means around four priming operations per month. Thus, it would take about 28 months to fill the separator at this rate. Over this period of average use, fluid loss occurs through the floor because of the high moisture vapor transfer rate. The ink solids are retained, but the fluid portion of ink is lost via the moisture vapor transfer, so that the separator foam material over time has high capacity to hold the waste ink directed to it small quantities at a time and does not have to be replaced, under normal operation.

The chamber body inlet of the separator is connected by flexible hose 63 to the cap 46, and the chamber body outlet of the separator is connected to the vacuum pump 58 by flexible hose 65. As explained below, the serpentine pathway in space 69 separates the ink from the air and the waste ink is absorbed and stored in the foam material 72, when ink is drawn into the separator 64 by the vacuum produced therein by the vacuum pump. This ink storage into the foam allows portability of the printer without ink migrating out of the cap or separator into the vacuum pump.

When it is necessary to prime the printhead, the carriage 16 is moved from the capped position towards fixed support member 45 until leg 67 of U-shaped pinch valve 66 contacts support member 45 causing the U-shaped pinch valve to rotate, so that leg 68 of the U-shaped structure pivots against flexible hose 63 and pinches it closed, i.e., pinch valve 66 is caused to close flexible hose 63 by movement of the carriage 16. Paper feed motor 60 is energized and diaphragm vacuum pump 58 evacuates the space 69 in the separator above an absorbent material, such as reticulated polyurethane foam 72, to a negative pressure of about minus 120 inches of $H_2O$. This negative pressure is attained in about 10 seconds, depending on pump design. Meanwhile the cap recess is still at ambient pressure because of the pinch valve closure. When the desired separator negative pressure is achieved, after about 10 seconds, the carriage is returned to the location where the nozzle face is capped, but the flexible hose 63 is no longer pinched closed. At this point, the cap is still sealed to the printhead nozzle face and the pinch valve is opened thereby subjecting the sealed cap internal recess to a negative pressure of minus 120 inches of $H_2O$, thereby priming the print cartridge. The print cartridge remains at this position for about one second. This time period is determined to achieve a specific relationship of pressure in the cap and flow impedance of the waste ink through the nozzles and the maintenance system air volume in order to yield a priming target of 0.2 cc ±0.05 cc of ink. When the evacuation of the separator is completed, the print cartridge carriage 16 is driven away from support member 45 and cap carriage 40 is moved in unison with the print cartridge carriage 16 towards the wiper blade(s) 30 by the urging of spring 44 and the print cartridge carriage 16 pushing on pawl 54 back to the capping position. It is at this point that the pinch valve is open, and the negative pressure from the separator is introduced to the cap and ink is sucked from the nozzles. After about one second of exposure to the negative pressure in the separator, the carriage 16 is moved, breaking the cap seal and stopping the priming. The print cartridge is moved past the wiper(s) 30 to a hold position adjacent the wiper(s) at a location between the wiper(s) and the printing zone for a predetermined time period to wait while the ink and air are sucked or purged from the cap to the separator. The vacuum pump is then shut off. When this has been accomplished, the carriage returns the print cartridge to the capped position to await for a printing mode command from the printer controller.

The predetermined time that the print cartridge is at a location where the flexible hose 63 is pinched closed and the predetermined time that the print cartridge is at the capped position (as controlled by the controller software) determines pressure profiles and waste volumes of ink. This control enables a spectrum of waste ink volumes and pressure profiles, two of which are when the print cartridge is initially installed (longer wait at the capped position to prime all ink flow paths between the nozzle and the supply cartridge and refresh or manual prime, discussed below (shorter wait at the capped position to prime the printhead).

Optionally, a manual prime button (not shown) is provided on the printer for actuation by a printer operator when the printer operator notices poor print quality caused by, for example, a nozzle that is not ejecting ink droplets. This manual priming by actuation of the manual prime button works substantially the same way as the automatic prime sequence described above, which is generally performed when the print cartridge is installed or any other sensed event which is programmed into the printer controller. The only difference is that the amount of lapsed time is reduced to 0.5 seconds after the pinch valve is opened to reduce the amount of ink sucked from the print cartridge to about 0.1 cc to reduce waste ink and prevent reduced printing capacity per print cartridge. Occasionally, a manual refresh prime may not be sufficient to improve print quality. Therefore, the controller with appropriate software would invoke the initial prime volumes after continued attempts were made to recover via manual refresh prime. For example, after two consecutive manual refresh prime attempts within a two minute period, the third attempt would be made by the printer controller at initial prime ink volumes.

While the cap is being purged of ink and the print cartridge is in the hold position, the paper feed motor is operating the vacuum pump to pump air and ink from the cap into the separator. Once in the separator, the ink is absorbed by the foam which stores the ink and prevents ink from entering the pump. (Ink in the pump could damage pump valves.) The separator enables printer portability, because any ink spilled or jarred from the printhead nozzles during printer relocation by the user will be absorbed in the separator. Humidification of cap 46 is also contributed by the separator foam material after at least one priming operation. The specific construction of the separator and the material selection for the floor (one having a high moisture vapor transfer rate) permits a relatively large waste ink volume over time because of the vapor loss through the separator floor and air being pumped through the cap and separator during printing, because the vacuum runs when the paper feed motor is running.

Many modifications and variations are apparent from the foregoing description of the invention, and all such modifications and variations are intended to be within the scope of the present invention.

We claim:

1. A waste ink separator for use in an ink jet printer maintenance station, comprising:

a rigid chamber body having sidewalls surrounding and extending from a top wall, the top wall having an inlet and an outlet and an interior surface with a plurality of ribs thereon;

a flexible bottom floor being sealably attached to the sidewalls and having a material providing a high moisture vapor transfer rate for the transfer of moisture therethrough and evaporization therefrom; and a foam material being placed in the separator and sandwiched between the bottom floor and ribs of the top wall, so that the ribs produce a flow path from the inlet to the outlet.

2. The waste ink separator of claim 1, wherein the ribs alternately extend from opposing sidewalls and have a length less than a distance between the opposing sidewalls, so that a flow path between the inlet and outlet is serpentine.

3. The waste ink separator of claim 2, wherein the sidewalls have distal end portions remote from the top wall from which the sidewalls extend and have exterior and interior surfaces, the exterior surfaces of the sidewalls have a closed coplanar groove in the distal end portions;

wherein the bottom floor has a relatively short closed wall extending therefrom with a distal edge having an inwardly directed rim parallel with the groove in the sidewalls; and wherein the sealable attachment of the bottom floor of the chamber body sidewalls is a snap on engagement of the rim into the sidewall groove achieved through the flexibility of the bottom floor.

4. The waste ink separator of claim 2, wherein the inlet is connected to said maintenance station for the ink jet printer by a flexible hose; and wherein the outlet is connected to a vacuum pump for withdrawal of waste ink from the maintenance station to the separator.

5. The waste ink separator of claim 4, wherein the ink jet printer has a translatable printhead with ink droplet ejecting nozzles that is selectively moved to a location adjacent the maintenance station; wherein the maintenance station has a cap for enclosing the printhead nozzles, the cap being connected to the separator by said flexible hose; and wherein the cap is selectively isolated and unisolated from the separator, so that a predetermined vacuum generated in the separator while the cap is isolated therefrom.

6. The waste ink separator of claim 5, wherein the printhead nozzles are primed and ink is sucked from the nozzles when the cap is unisolated from the separator after the separator has had a vacuum generated therein and the nozzles are exposed to the vacuum in said separator.

* * * * *